US006729288B2

(12) United States Patent
Yamamoto et al.

(10) Patent No.: US 6,729,288 B2
(45) Date of Patent: May 4, 2004

(54) LASH ADJUSTER FOR USE IN VALVE GEAR

(75) Inventors: Ken Yamamoto, Shizuoka (JP); Eiji Maeno, Shizuoka (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 10/327,126

(22) Filed: Dec. 24, 2002

(65) Prior Publication Data

US 2003/0145817 A1 Aug. 7, 2003

(30) Foreign Application Priority Data

Dec. 27, 2001 (JP) ..... 2001-397213
Mar. 28, 2002 (JP) ..... 2002-091348

(51) Int. Cl.[7] ..... F01L 1/14
(52) U.S. Cl. ..... 123/90.54; 74/569
(58) Field of Search ..... 123/90.52, 90.53, 123/90.54, 90.48, 90.49; 74/569

(56) References Cited

U.S. PATENT DOCUMENTS 3,791,355 A * 2/1974 Bergmann et al. ..... 123/90.27
6,032,630 A * 3/2000 Yamamoto et al. ..... 123/90.54
6,109,228 A * 8/2000 Yamamoto et al. ..... 123/90.54

FOREIGN PATENT DOCUMENTS

JP 2000130114 A * 5/2000 ..... F01L/1/22

* cited by examiner

*Primary Examiner*—Thomas Denion
*Assistant Examiner*—Zelalem Eshete
(74) *Attorney, Agent, or Firm*—Wenderoth, Lind & Ponack, L.L.P.

(57) ABSTRACT

A lash adjuster is provided which can keep a constant valve lifting amount. An adjust screw is brought into threaded engagement in a threaded hole formed in the bottom surface of an end plate of a lifter body. The adjust screw is biased in the axial direction by an elastic member. The threads of female threads of the threaded hole and the male threads on the adjust screw are serrated. The surface roughness of the pressure flanks of the serrated threads is set to 0.4 or over to prevent the adjust screw from retracting while turning when push-in loads are applied to the adjust screw from the valve stem, thereby stabilizing the valve lifting amount. Also, a slide member is mounted between the adjust screw and the valve stem and a retaining device is provided to prevent the slide member from turning relative to the nut member while supporting it so as to be movable in the axial direction.

17 Claims, 13 Drawing Sheets

LASH ADJUSTER FOR USE IN VALVE GEAR

BACKGROUND OF THE INVENTION

This invention relates to a lash adjuster for automatically adjusting the valve clearance of a valve gear in an internal combustion engine.

In a valve gear for opening and closing an intake valve or an exhaust valve (hereinafter simply referred to as a valve) by rotating a cam, a valve clearance is automatically adjusted by means of a lash adjuster.

As a lash adjuster of this type, the present applicant has already proposed a thread type lash adjuster which can reduce the axial length of the valve gear, is small in the number of parts and easy to assemble (JP patent publication 11-62519).

With the lash adjuster of this publication, as shown in FIG. 14, a nut member 8 is fixed e.g. by brazing to the bottom surface of an end plate 2 of a lifter body 1. A threaded hole 3 is formed in the nut member 8. An adjust screw 4 threadedly engaging in the threaded hole 3 is axially biased by an elastic member 5 mounted in a closed end of the threaded hole 3. Female threads 3*a* of the threaded hole 3 and male threads 4*a* formed on the adjust screw 4 are serration-shaped so that the flank angle of pressure flanks 6, which bear push-in loads applied to the adjust screw 4, is larger than the flank angle of clearance flanks 7. The serrated threads have such a lead angle that under the bias of the elastic member 5, the adjust screw 4 will move in the axial direction while turning.

The lash adjuster having such a structure is, as shown in FIG. 14, mounted between a cam 10 and a valve stem 12 provided on a valve 11 to press the end face of the valve stem 12 against the end face of the adjust screw 4 by the bias of a valve spring 13 for biasing the valve stem 12 toward the cam 10 and serves to transmit the pressing force to the cam 10 through the lifter body 1 so that the valve 11 will be opened and closed as the cam 10 rotates.

In mounting such a lash adjuster, if a valve clearance is produced between the valve stem 12 and the adjust screw 4, by the biasing force of the elastic member 5, the adjust screw 4 will move in the axial direction along the clearance flanks 7 while turning, thus absorbing the valve clearance.

Also, when the adjust screw 4 receives a push-in force from the valve stem 12, it will retract until axial clearances formed between the female threads 3*a* and the male threads 4*a* disappear. When a further push-in force is applied, it will be borne by the pressure flanks 6, which prevent the adjust screw 4 from retracting while turning.

If the push-in load applied from the valve stem 12 to the adjust screw 4 is a continuously acting varying load, the adjust screw 4 will retract axially while turning to a position where the minimum value of the varying load becomes zero, thereby keeping uniform the valve clearance.

With the already proposed lash adjuster, when the push-in force is applied to the adjust screw 4, the circumferential component of the vertical resistance produced between the thread surfaces gives the adjust screw 4 a turning force.

At this time, if the frictional force working between the thread surfaces is large enough to give a sufficient turning resistance, the adjust screw 4 is prevented from retracting. But if the frictional force is insufficient, the adjust screw 4 will retract while turning, so that the valve lifting amount decreases. If the retracting amount exceeds the ramp of the cam 10, the valve 11 will get impulsively seated on the valve seat 18, producing an abnormal sound.

The surface roughness of the pressure flanks 6 of the female threads 3*a* and the male threads 4*a* greatly influences the frictional force between the thread surfaces. Generally, for oil-lubricated frictional surfaces, the larger the surface roughness, the higher the friction coefficient. Thus, with a lash adjuster as described above, it is preferable that the surface roughness of the female threads 3*a* and the male threads 4*a* is large.

Mass-produced screws are typically manufactured by rolling in view of lower cost and high strength. The surface roughness of flanks (thread surfaces) of screws formed by rolling is relatively small.

The inventors of the present invention formed the male threads 4*a* of the adjust screw 4 of the lash adjuster by rolling, and measured the valve lifting amount in a revolving number sweeping test for a lash adjuster in which is mounted this adjust screw 4. The test results are shown in FIG. 5. The surface roughness Ra of the flanks 6 and 7 of the male threads 4*a* of the adjust screw 4 was 0.1.

In the graph of FIG. 5, the bent line A1 at the lower part of the graph shows the number of revolutions of the crankshaft. It linearly increases from the idling revolution 800 (r/min) to MAX 6000 (r/min) and linearly decreases back to 800 (r/min).

The upper part of the graph shows a lifting curve B1 of the valve 11. In the graph, only one lifting curve is shown enlarged. But actually, such lifting curves appear continuously in the direction of the horizontal axis (that is, time axis) of the graph. The density of lifting curves are coarse in a region where the number of revolutions of the crankshaft is low and it increases as the number of revolutions of the crankshaft increases. Displaying such lifting curves is difficult. Thus, they are shown with the valve closed positions and the valve open positions connected by lines. In the graph of FIG. 5, the upper line C shows the valve closed position and the lower line D shows the valve open position.

As is apparent from the test results, if the surface roughness of the threaded surfaces of the male threads 4*a* of the adjust screw 4 is relatively smooth, under some conditions of the lubricating oil, a sufficient frictional force would not be obtained between the flank surfaces, so that stoppage upon loading is delayed momentarily, thus reducing the valve lifting amount.

An object of this invention is to provide a lash adjuster in which the valve clearance is automatically adjusted by axial movement of the adjust screw having serrated male threads, and the valve lifting amount is kept constant by providing a sufficient frictional resistance between the thread surfaces during loading for the adjust screw to stop.

With the lash adjuster mounted in a direct type valve gear shown in FIG. 11, due to displacement of the relative position of the cam 10 and the lifter body 1 the lifter body tends to turn under a turning force by contact with the cam 10. Also, the valve 11, too, tends to turn according to operating conditions. These rotations are not constant in the rotating direction and rotating speed. When such a rotation occurs, the thread engagement portions between the threaded hole 3*a* and the adjust screw 4 are acted by torsional moment produced due to a relative turning between the lifter body 1 and the valve 11.

If such a torsional moment is relatively small, even if it is a turning force in such a direction as to push in the adjust screw 4, frictional force between the pressure flanks 6 will prevent the adjust screw from slip-turning.

On the other hand, the torsional moment applied to the thread engagement portions between the adjust screw 4 and the threaded hole 3*a* depends on the relative turning speed of the lifter body 1 and the valve 11 and the frictional force between the end faces of the valve stem 12 and the adjust screw 4, so that its intensity and direction vary according to conditions such as the kind of engine, the number of cylinders or the number of revolutions.

If the torsional moment should be inputted at such an intensity as to overcome the frictional force between the pressure flanks 6 in such a direction as to push in the adjust screw 4, the adjust screw would retract, thereby varying the valve lifting amount. If the retracting amount exceeds the ramp height of the cam 10, the valve 11 may be impulsively seated on the valve seat 18, thus producing abnormal sound.

The second object of this invention is to provide a lash adjuster which can maintain a stable valve lifting amount under any conditions, irrespective of the relative turning speed between the lifter body and the valve stem or the frictional coefficient of the abutting portions, and which can be easily mounted in a valve gear.

SUMMARY OF THE INVENTION

To achieve the first object, according to this invention, there is provided a lash adjuster for use in a valve gear, comprising a lifter body having an end plate, mounted between a cam and a valve stem and supported so as to be slidable in the axial direction, an adjust screw in threaded engagement with a threaded hole formed in the bottom surface of the end plate of the lifter body, and an elastic member biasing the adjust screw toward the top end of the valve stem, wherein threads of female threads of the threaded hole and male threads formed on the outer periphery of the adjust screw are serrated so that the flank angle of pressure flanks of the male threads and the female threads, which receive axial push-in force applied to the adjust screw, is larger than the flank angle of clearance flanks of the male threads and the female threads, wherein the surface roughness Ra of the pressure flanks of at least one of the female threads and the male threads is set to 0.4 or over.

With this arrangement, it is possible to obtain a sufficient frictional force between the pressure flanks of the female threads of the threaded hole and the male threads of the adjust screw. Thus, even when an axial push-in load is applied from the valve stem to the adjust screw, the adjust screw will not retract while turning. Thus, the valve lifting amount varies little, so that it is possible to obtain stable valve lifting properties.

The pressure flank having the surface roughness Ra of 0.4 or over may be at least one of the pressure flanks of the male threads of the adjust screw and the pressure flanks of the female threads of the threaded hole, or both of them.

As a method of obtaining pressure flanks having a surface roughness Ra of 0.4 or over, the threads may be formed by cutting, knurling after forming the threads by rolling, or shot-peening after forming the threads by rolling.

By employing these methods, the surface roughness Ra of 0.4 or over will be obtained not only on the pressure flanks but on the clearance flanks. But, if the surfaces of the female threads and of the male threads are rougher than necessary, movement of the adjust screw toward the protruding side would worsen. While the valve clearance is increasing, trouble may occur that even when the axial load from the valve stem becomes zero, and even after the adjust screw has contacted the clearance flanks, it would not begin slip turning. In order to prevent such a problem, the surface roughness Ra of the clearance flanks is set to less than 25.

By setting the clearance flanks to less than 25, the adjust screw will move smoothly in the protruding direction. Thus it is possible to obtain smooth operating properties.

To achieve the second object, according to this invention, there is provided a lash adjuster for use in a valve gear, comprising a lifter body having an end plate and mounted between a cam and a valve stem so as to be slidable in the axial direction, a nut member fixedly mounted on the bottom surface of the end plate of the lifter body, an adjust screw in threaded engagement with a threaded hole formed in the nut member, and an elastic member mounted in the threaded hole to bias the adjust screw in the axial direction, wherein threads of female threads of the threaded hole and male threads formed on the outer periphery of the adjust screw are serrated so that the flank angle of pressure flanks of the male threads and the female threads, which receive axial push-in force applied to the adjust screw, is larger than the flank angle of clearance flanks of the male threads and the female threads, wherein a slide member is mounted between the adjust screw and the valve stem and a retaining means is provided to prevent the slide member from turning relative to the nut member while supporting the slide member so as to be movable in the axial direction.

By mounting the slide member between the adjust screw and the valve stem and preventing the slide member from turning relative to the nut member while allowing the slide member to move in the axial direction, even if the valve stem turns relative to the lifter body, no turning moment will be transmitted to the adjust screw, so that only axial push-in force is transmitted. The axial push-in force is borne by the pressure flanks at the thread engagement portions between the threaded hole and the adjust screw, so that the adjust screw is prevented from retracting while turning. As a result, it is possible to maintain a stable valve lifting amount.

By retaining the slide member by means of the retaining means, in the stage before the lash adjuster is mounted in a valve gear, it is possible to prevent the slide member from falling off the lifter body, so that it is possible to make it easy to mount the lash adjuster.

As a method of preventing the slide member from turning and making it inseparable, it is conceivable to provide a cylindrical portion on the outer peripheral portion of the nut member, form an axial groove at the bottom end of the cylindrical portion, fit a turn-preventive piece provided on the outer periphery of the slide member in this groove so that the slide member is prevented from turning but is axially movable, and prevent the slide member from turning by mounting a snap ring on the inner periphery of the lifter body.

But in this case, a problem arises that the outer peripheral wall of the nut member would be thick, thus increasing the weight of the lash adjuster.

In order to solve this problem, according to the present invention, the retaining means comprises an elastic ring having its outer peripheral portion fitted in a groove formed in the inner periphery of the lifter body, and a ring-shaped turn-preventive member pressed against the bottom surface of the nut member by the elastic ring, a plurality of guide pieces formed to extend downwardly from the inner periphery of the turn-preventive member, the guide pieces each being formed with a guide hole, the slide member having a plurality of turn-preventive pieces formed on the outer periphery thereof, the turn-preventive pieces being inserted in the guide holes to prevent the slide member from turning and support the slide member so as to be movable in the axial direction.

By employing the retaining means, it is possible to form the turn-preventive member by pressing a thin metal plate. Thus it is possible to suppress increase in the weight of the lash adjuster to a minimum and to provide a lightweight, low-cost lash adjuster.

As the elastic ring, a disc spring having a cut-off portion in its circumference may be used. This elastic ring is easy to mount and has not only the function as a spring, but also the function as a snap ring. Thus, it is not necessary to use a separate snap ring to prevent the elastic ring from coming off. Thus it is possible to reduce the number of parts, thereby reducing the cost.

By forming a plurality of protrusions on the outer periphery of the turn-preventive member and coupling the turn-preventive member to the nut member by caulking the protrusions, it is possible to reliably prevent the turn-preventive member from turning. Thus it is possible to more reliably prevent the slide member from turning.

Further, by mounting the nut member in contact with the bottom surface of the end plate of the lifter body and pressing it against the bottom surface of the end plate with the elastic ring, it is possible to prevent the nut member from turning by the bias of the elastic ring. Thus, compared with the case in which the nut member is fixed to the bottom surface of the end plate of the lifter body by brazing, it is possible to reduce the cost of the lash adjuster.

In the lash adjuster of the present invention, the retaining means may comprise an elastic ring mounted in a groove formed in the inner periphery of the lifter body for pressing the nut member against the bottom surface of the end plate of the lifter body, the nut member being formed with cutouts in an outer periphery thereof at opposed positions, the slide member having L-shaped turn-preventive pieces adapted to be fitted into the cutouts formed in the nut member and prevented by the elastic ring from coming out of the cutouts.

By adopting such a retaining means, the turn-preventive member of the abovesaid embodiment is not needed any more. This reduces the number of the parts of the lash adjuster and its cost and weight.

Other features and objects of the present invention will become apparent from the following description made with reference to the accompanying drawings, in which:

DETAILED DESCRIPTION OF THE PREFERRED EMBODIMENTS

Figure 1:
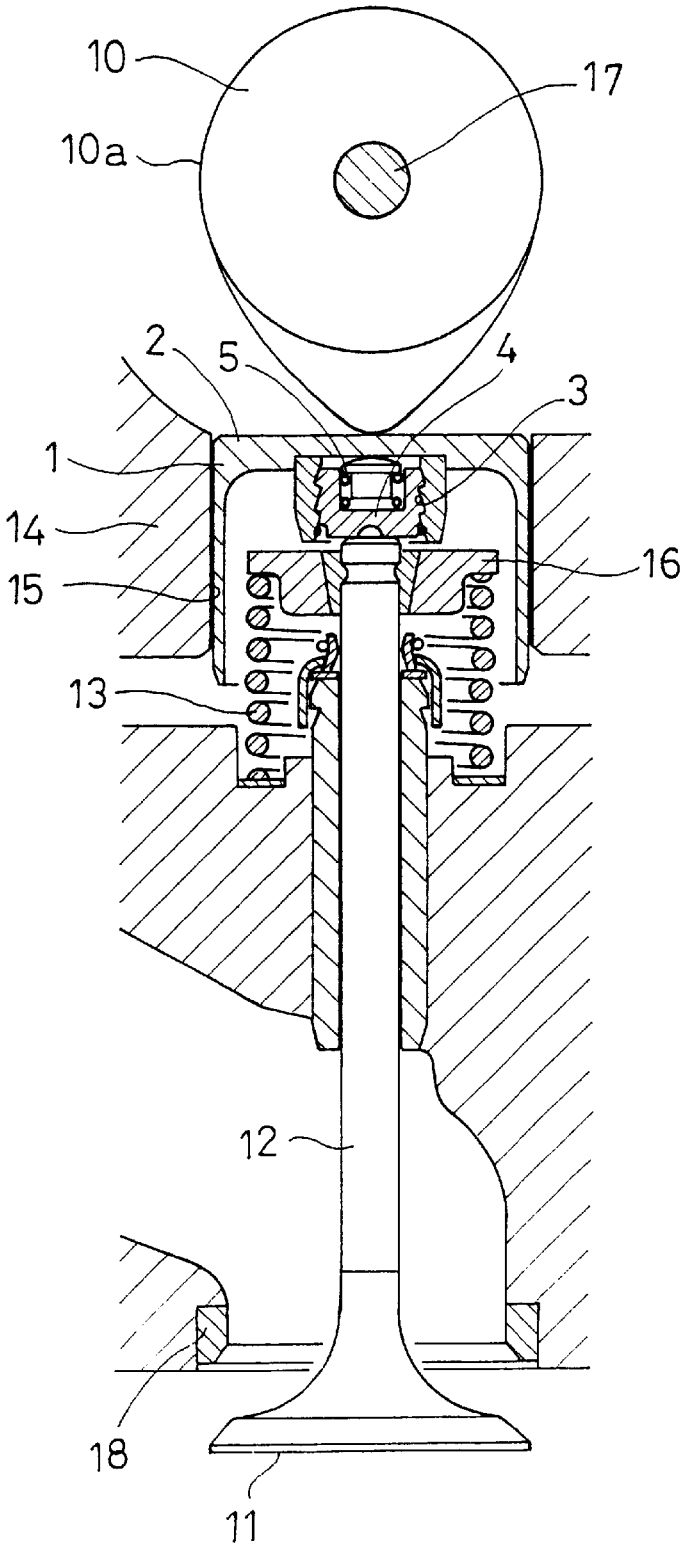
FIG. 1 is a sectional front view of the valve gear in which is mounted the lash adjuster according to this invention.
Figure 2:
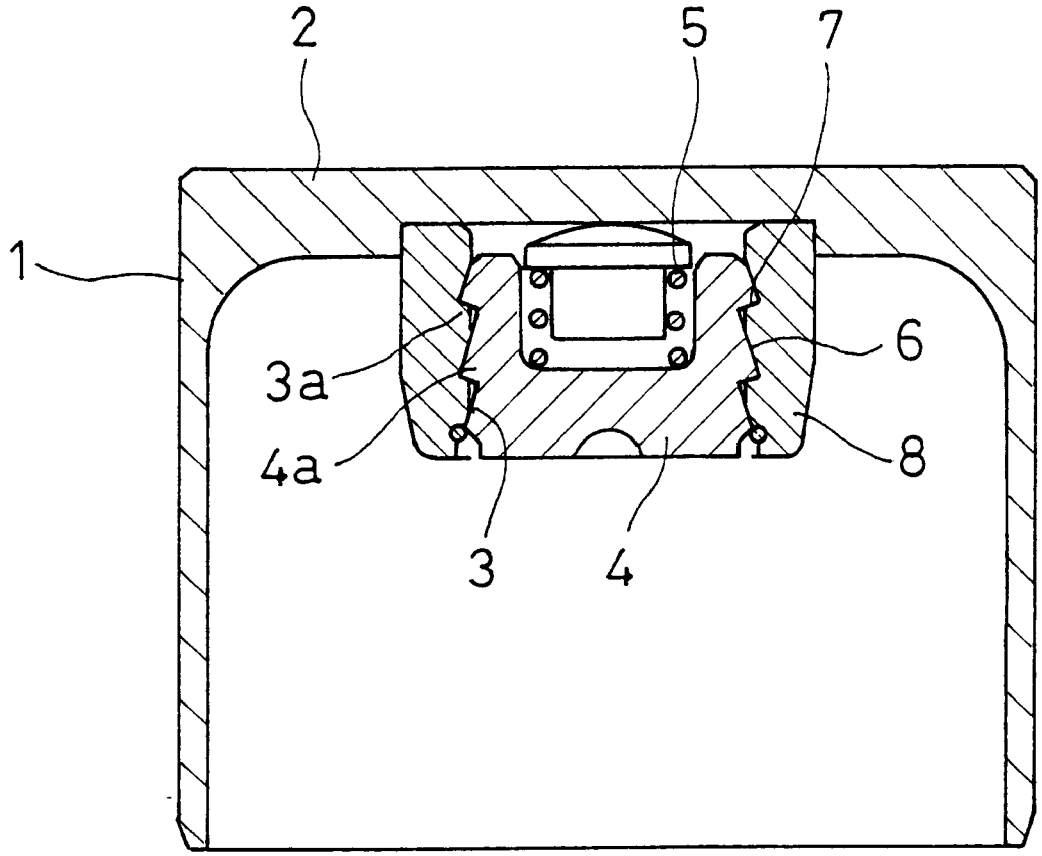
FIG. 2 is an enlarged sectional view of the lash adjuster shown in FIG. 1.

The embodiments will be described with reference to the drawings. In FIG. 1, the lash adjuster has a lifter body 1, an adjust screw 4 and an elastic member 5. A nut member 8 is fixed to the bottom surface of the end plate 2 of the lifter body 1 (FIG. 2). The adjust screw 4 is in threaded engagement with the threaded hole 3 formed in the nut member 8. The adjust screw 4 is biased in the axial direction by the elastic member 5 which is mounted in the closed end of the threaded hole 3.

The female threads 3*a* formed on the threaded hole 3 and the male threads 4*a* formed on the outer periphery of the adjust screw 4 are serrated. The surface roughness Ra of the pressure flanks 6 and the clearance flanks 7 of the serrated threads is 0.4 or over and less than 25.

In order to form threads having a rough surface, they may be formed by cutting, knurling after forming the threads by rolling, or by shot-peening instead of knurling.

Formation of the threads by cutting roughens the surface of the flanks 6 and 7 more easily than by forming the threads by rolling.

On the other hand, if shot-peening is carried out after rolling, it is possible to shorten the working time per piece compared with cutting. Thus it is possible to cope with mass-production at a low cost.

Twenty adjust screws 4 having threads formed by rolling were prepared, and acute-angled blast material called grit were shot against the adjust screws 4 for 30 seconds, and the surface roughness before and after shot-peening was measured. The results are shown in Table 1.

Here, the surface roughness Ra was measured for the pressure flanks in the axial direction. Measurement of Ra was carried out under JISB0601 of JIS. The surface roughness is preferably substantially equal in the axial direction and circumferential direction.

As is apparent from Table 1, by shot-peening after rolling, it is possible to make the surface roughness Ra of the threads 0.4 or over.

In order to know what influence the surface roughness of the threads of the adjust screw 4 has on the operation of the valve gear, seven adjust screws of which the surface roughnesses of the threads of the male threads 4*a* were different from one another were prepared, and the operating properties of lash adjusters in which were mounted these adjust screws were tested. The results are shown in Table 2.

As is apparent from Table 2, in adjust screws 4 in which the surface roughnesses of the threads were 0.4 or over and less than 25, the stability of the valve lifting amount and smoothness during retraction of the adjust screws 4 were good.

Further, an adjust screw having the male threads 4 formed by cutting so that the surface roughness Ra of the threads of the male threads 4*a* would be 1.6 was mounted in a lash adjuster and the valve lifting amount in a revolving number sweep test was determined. The results are shown in FIG. 3.

Figure 3:
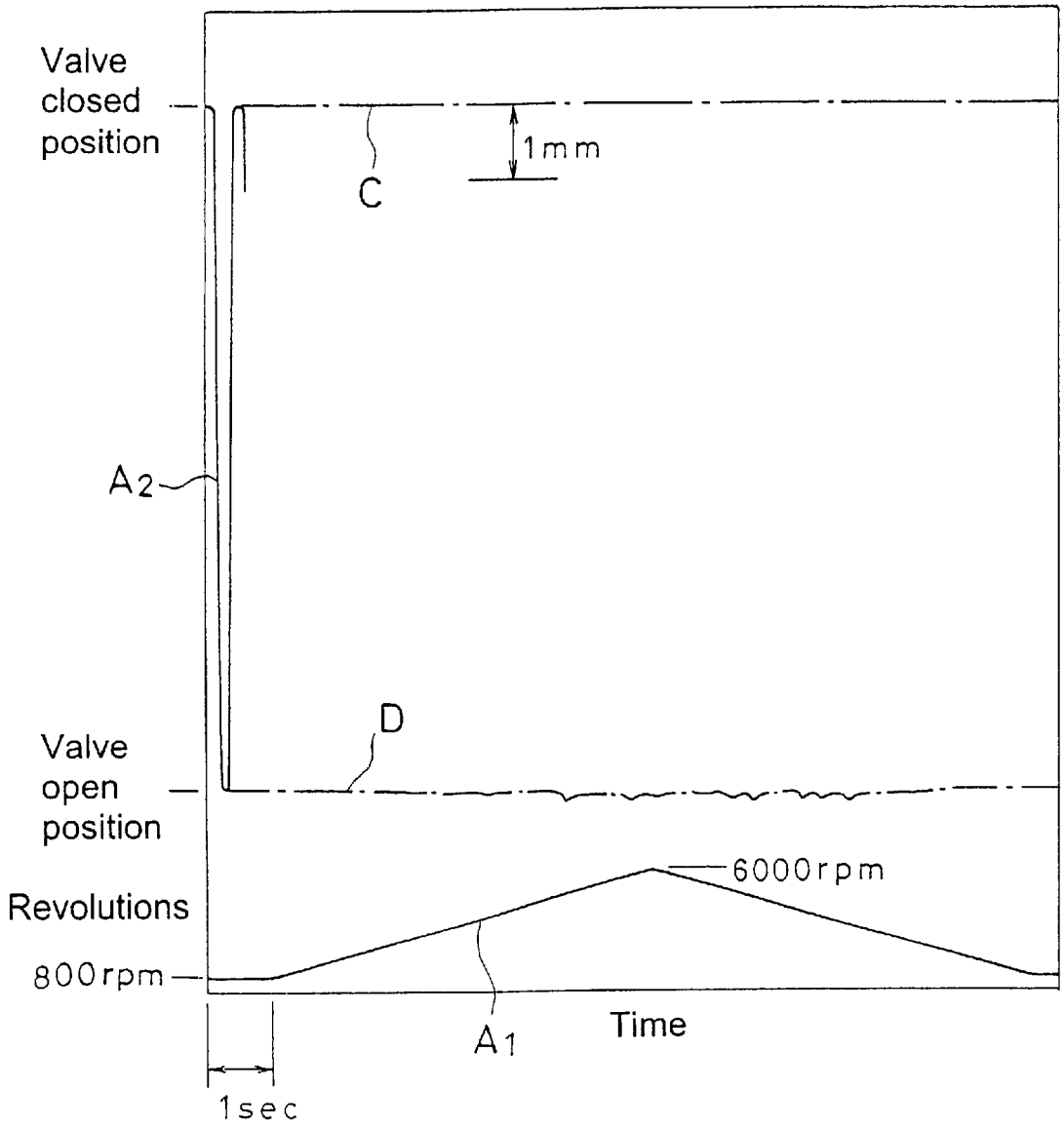
FIGS. 3 and 4 are graphs showing the results of a test for the valve lifting properties of the valve gear in which is mounted the lash adjuster according to this invention.

The bent line A1 at the lower part of the graph shown in FIG. 3 shows the number of revolutions of the crankshaft. The upper part of the graph shows a valve lift curve A2. The line C at the upper portion shows closed positions of the valve, while the line D at the lower part shows open positions of the valve. The number of revolutions of the crankshaft is the same as in FIG. 5.

As will be apparent from FIG. 3, if the surface roughness of the threads is relatively rough, even when the screw 4 receives axial loads transmitted from the valve stem, frictional force sufficient to prevent rotation of the adjust screw 4 is obtained. As a result, the valve lifting amount varies little, so that it is possible to obtain always stable valve lifting properties.

An adjust screw having threads formed by rolling was subjected to shot-peening so that the surface roughness of the threads would be 0.4. The adjust screw thus prepared was mounted in a lash adjuster and tested to determine the valve lifting amount in a revolving number sweep test. The results are shown in FIG. 4.

Figure 4:
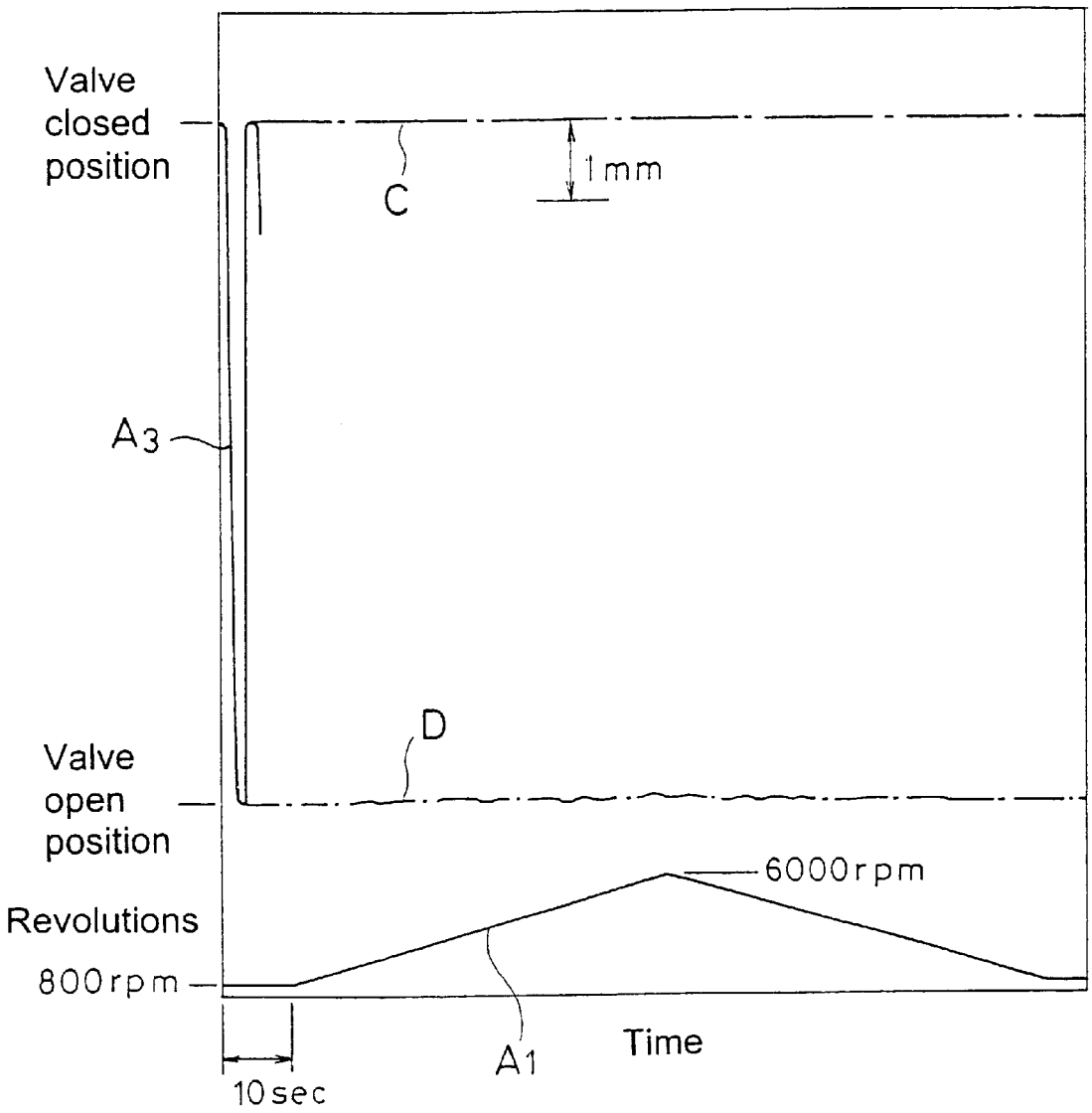

The bent line A1 at the lower part of the graph shown in FIG. 4 shows the number of revolutions of the crankshaft. The upper part of the graph shows a valve lift curve A3. The line C at the upper portion shows closed positions of the valve, while the line D at the lower portion shows open positions of the valve. The number of revolutions of the crankshaft is the same as in FIG. 3.

Figure 5:
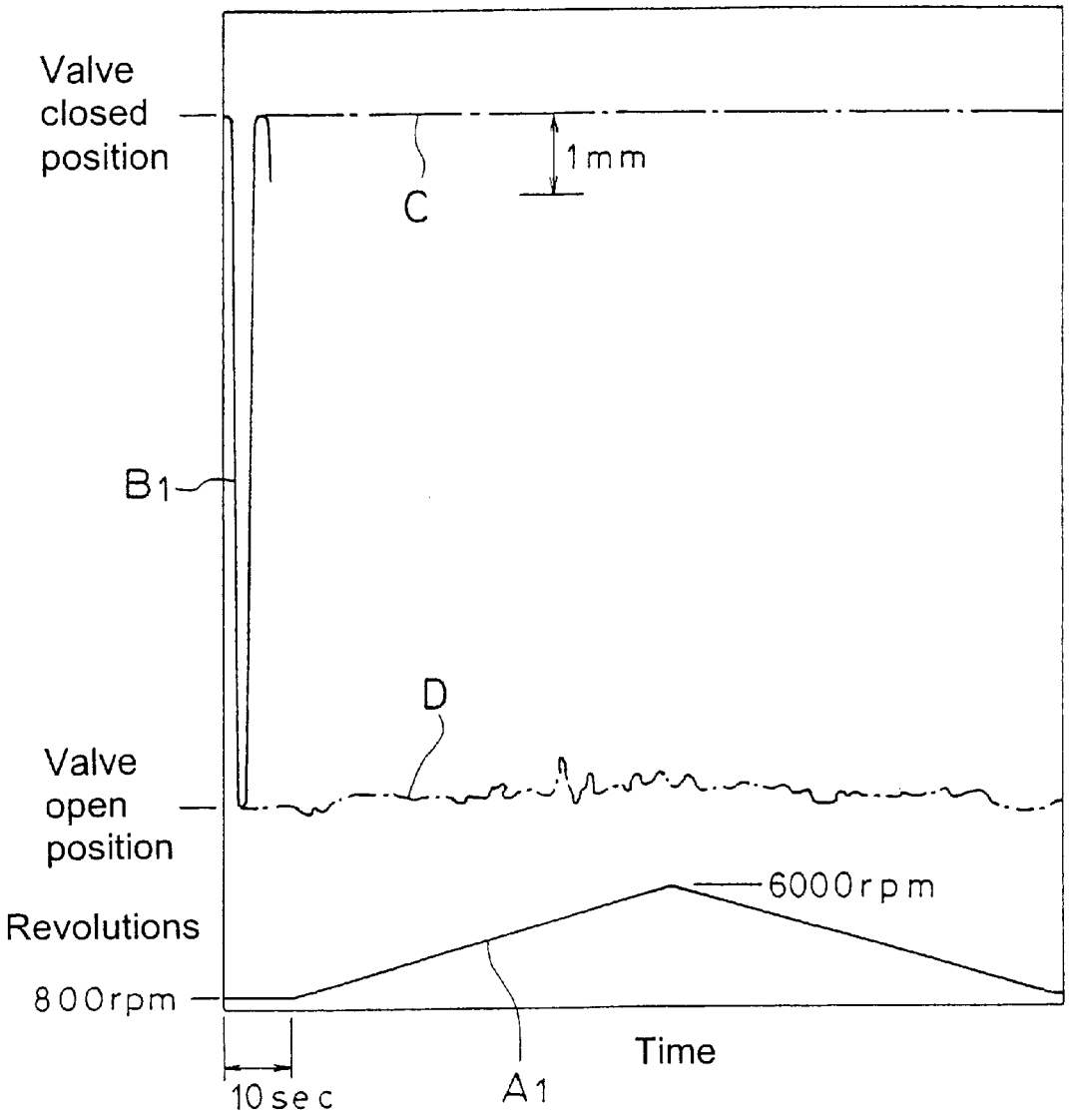
FIG. 5 is a similar graph showing the results of a test for a valve gear in which is mounted a conventional lash adjuster.

As is apparent from FIG. 4, by the effect of shot peening on increase in the surface roughness, compared with the case of rolling only as shown in FIG. 5, the frictional resistance between the crank surfaces increases, so that slipping at the thread portions during loading is prevented. Thus, stable valve lifting amounts are obtained.

Next, the second embodiment of this invention will be described below with reference to the drawings.

Figure 6:
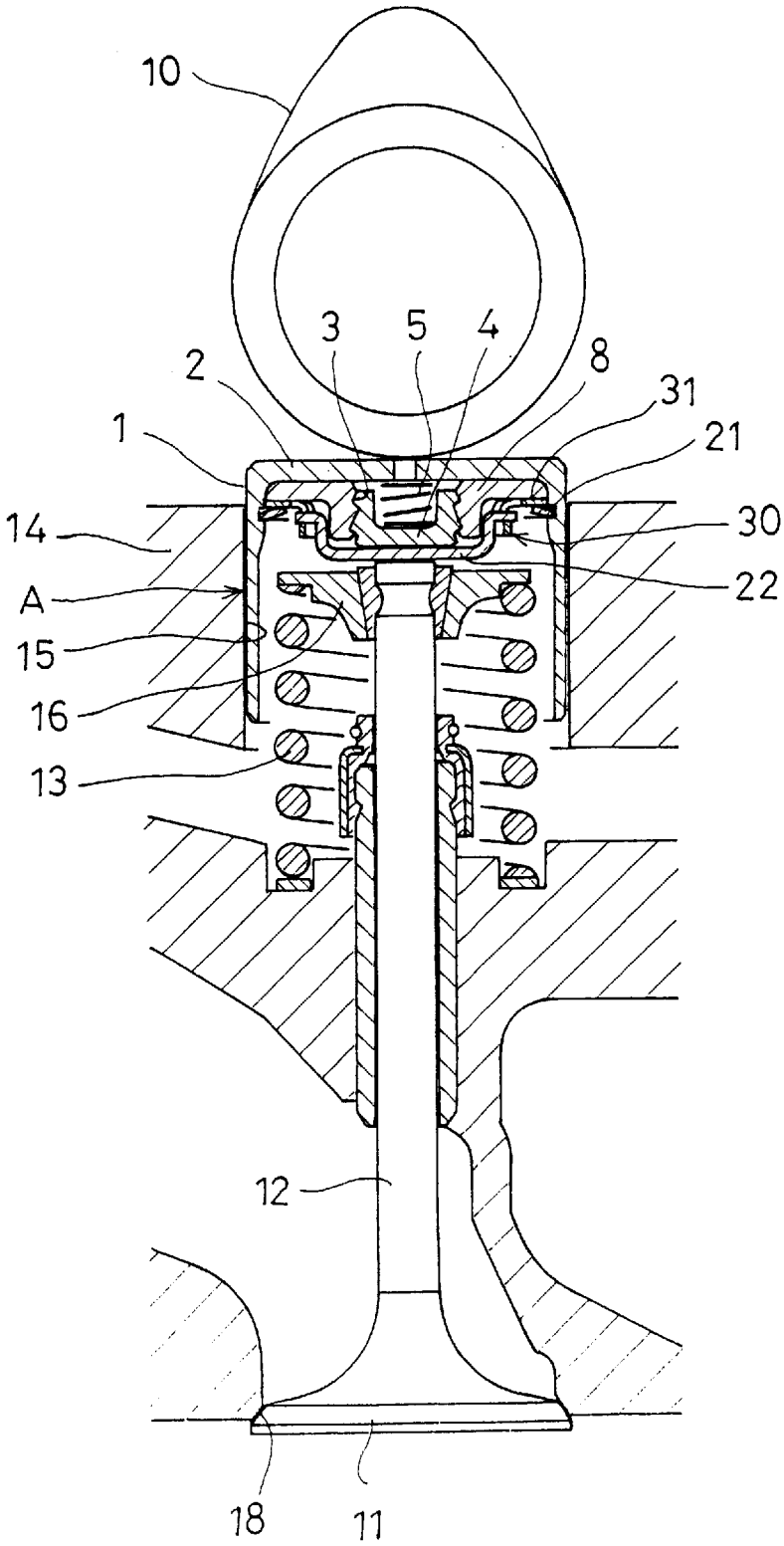
FIG. 6 is a vertical sectional front view of a valve gear in which is mounted the second embodiment of the lash adjuster according to this invention.

FIG. 6 shows the lash adjuster A according to this invention mounted between a cam 1 and a valve stem 12 of a direct type valve gear.

The valve stem 12 has a spring retainer 16 at its top end and is biased in such a direction that a valve 11 at its bottom end is pressed against a valve seat 18 by the bias of a valve spring 13 applied to the spring retainer 16.

Figure 7A:
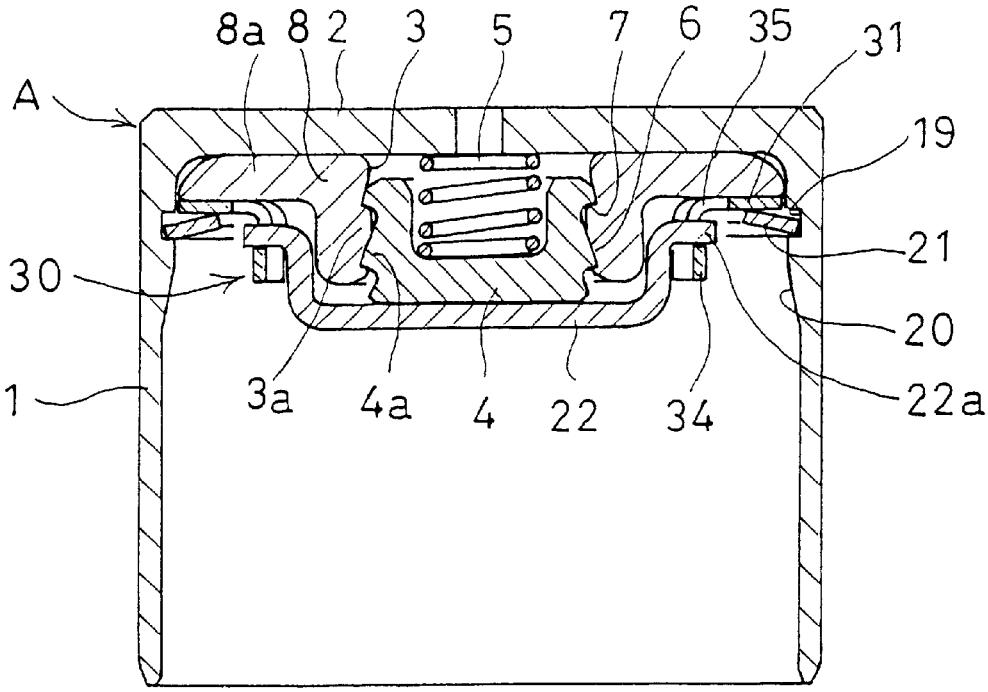
FIG. 7A is a vertical sectional front view of the lash adjuster shown in FIG. 6.
Figure 7B:
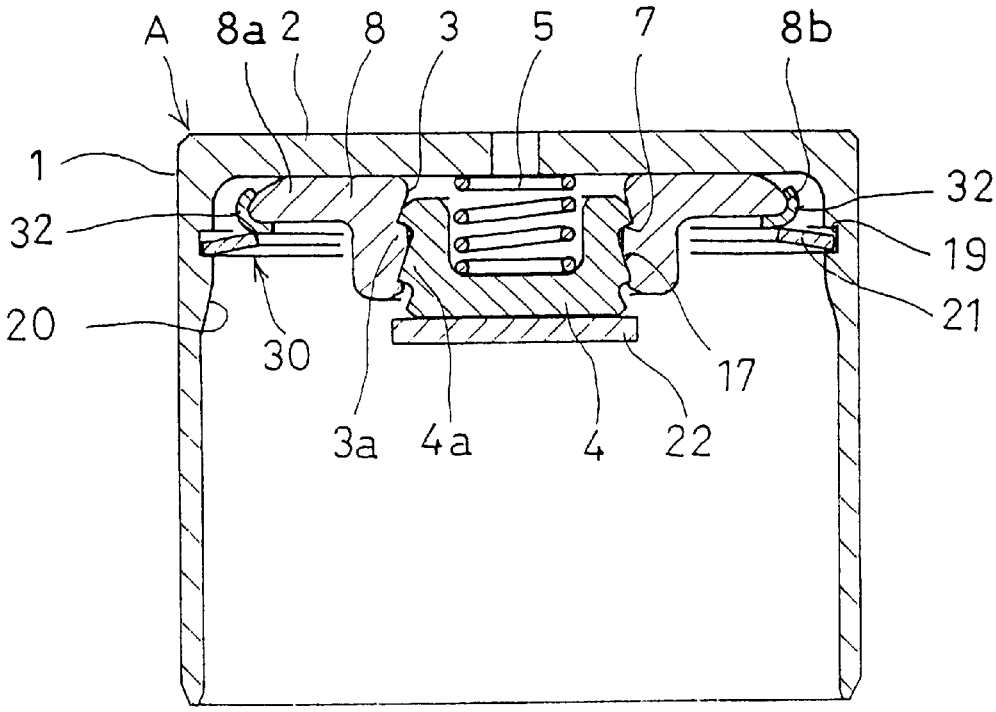
FIG. 7B is a vertical sectional side view thereof.
Figure 8:
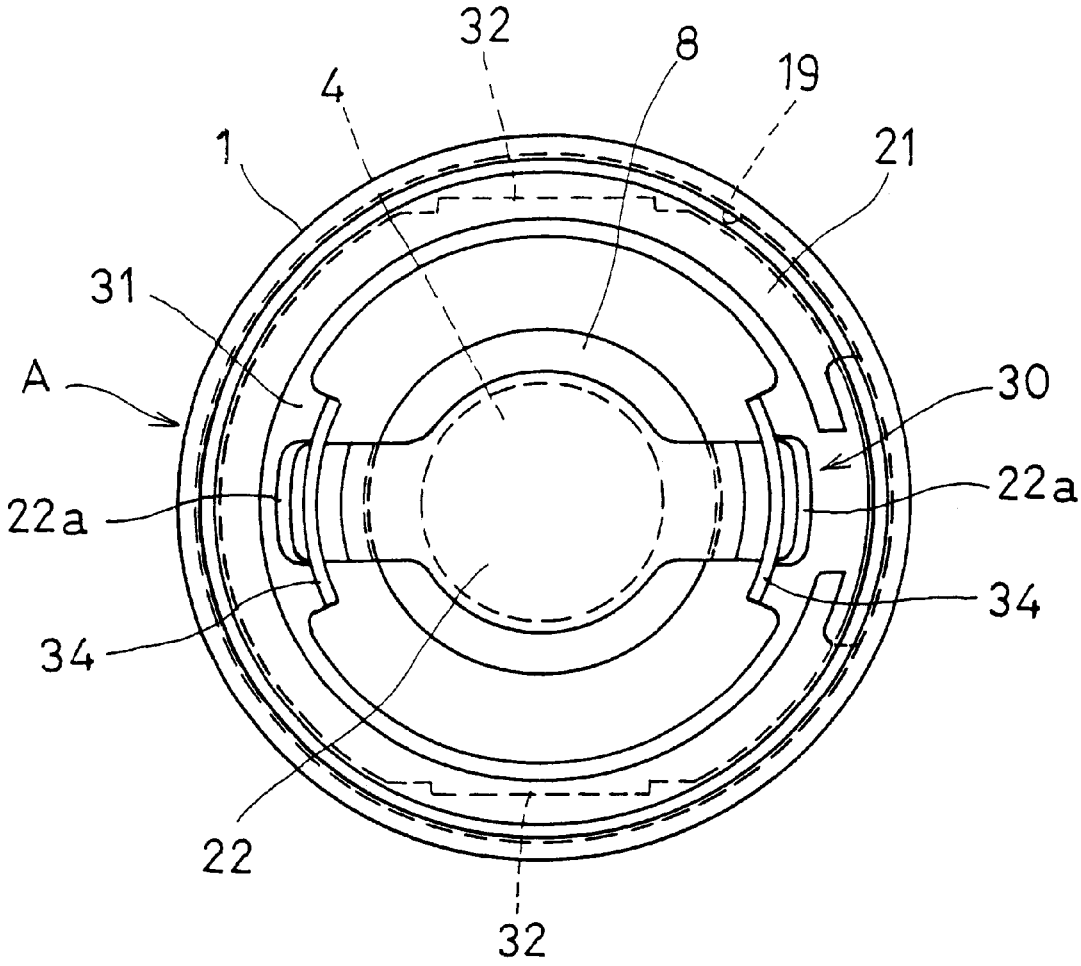
FIG. 8 is a bottom view of FIG. 7A.
Figure 14:
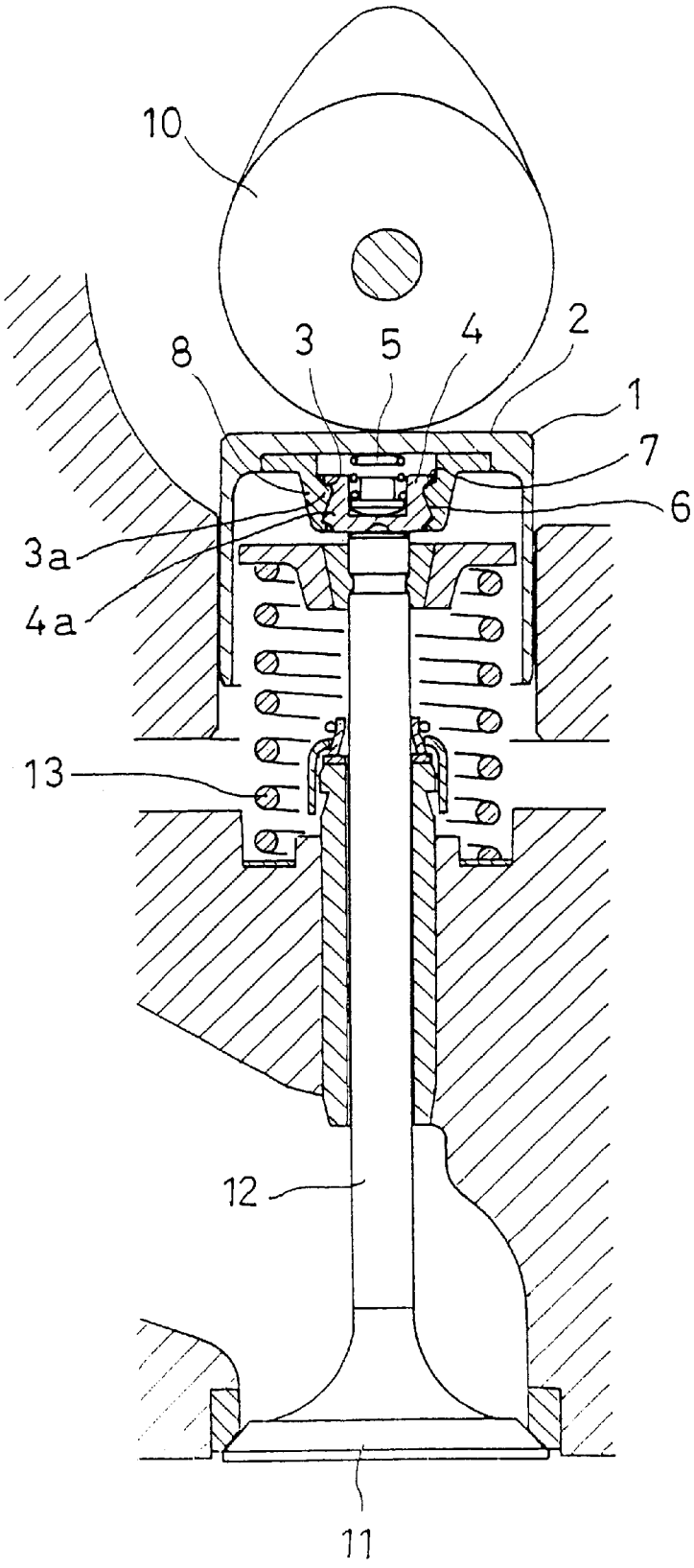
FIG. 14 is a vertical sectional front view of a valve gear in which is mounted a conventional lash adjuster.

As shown in FIGS. 7 and 8, the lash adjuster A has a lifter body 1 as with the lash adjuster shown in FIG. 14. As shown in FIG. 6, the lifter body 1 is slidable in a guide hole 15 formed in a cylinder head 14. The lifter body 1 has an end plate 2 that is in contact with the cam 10. At the bottom of the end plate 2, a nut member 8 is provided.

A threaded hole 3 formed in the nut member 8 is closed by the end plate 2. An adjust screw 4 threadedly engaged in the threaded hole 3 is biased in the axial direction by an elastic member 5 mounted in the closed end of the threaded hole 3.

Threads of female threads 3*a* of the threaded hole 3 and those of male threads 4*a* formed on the outer periphery of the adjust screw 4 are serrated such that the flank angle of pressure flanks 6, which bear push-in force applied to the adjust screw 4 is larger than the flank angle of clearance flanks 7. The serrated threads have such a lead angle that the adjust screw 4 moves in the axial direction while turning by the bias of the elastic member 5.

As shown in FIGS. 7 and 8, at the upper part of the inner periphery of the lifter body 1, a groove 19 and a tapered surface 20 thereunder are formed. An elastic ring 21 is mounted in the groove 19.

Figure 9:
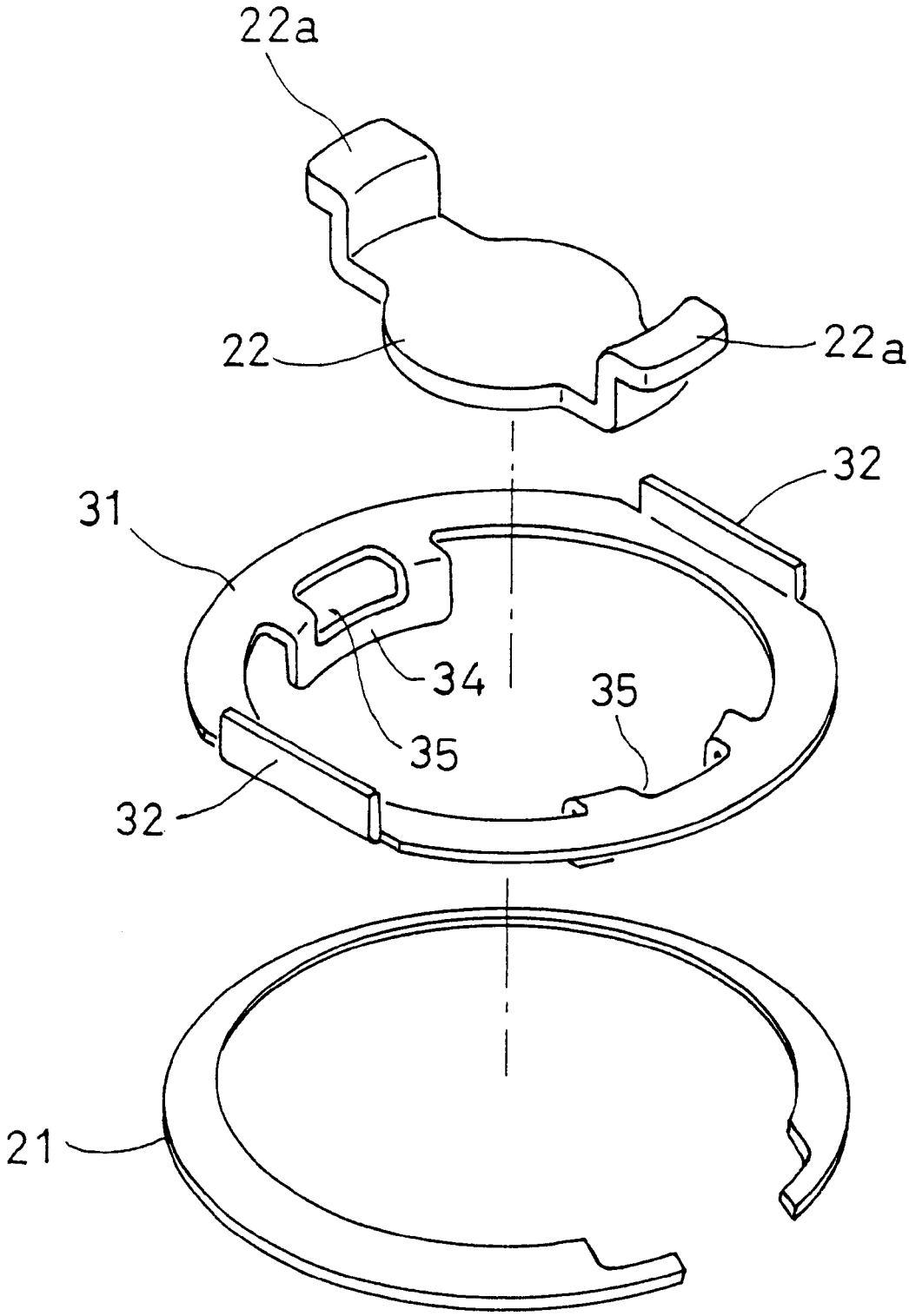
FIG. 9 is an exploded perspective view showing the slide member, turn-preventive member and elastic ring forming the lash adjuster.

As shown in FIG. 9, the elastic ring 21 comprises a disc spring having a cut-off portion in its circumference so as to be resiliently deformable in diametric and axial directions to press a flange 8*a* of the nut member 8 against the bottom surface of the end plate 2 of the lifter body 1 by its axial resilience, thereby preventing the nut member 8 from turning relative to the lifter body 1.

The nut member 8 may be fixed to the end plate 2 of the lifter body 1 by brazing to prevent it from turning relative to the lifter body 1.

As shown in FIG. 6, between the adjust screw 4 and the valve stem 12, a slide member 22 is mounted. The slide member 22 is prevented from turning relative to the nut member 8 by a retaining mechanism 30, but supported so as to be movable in the axial direction.

As shown in FIGS. 7 and 8, the retaining mechanism 30 has a ring-shaped turn-preventive member 31 provided under the nut member 8 and fixed to the nut member by caulking a pair of protrusions 32 provided at opposed positions on its outer periphery so as to enclose a flat portion 8*b* formed on the outer periphery of the flange 8*a* of the nut member 8.

Also, a pair of guide pieces 34 are provided to extend downwardly from opposed positions on the inner periphery of the turn-preventive member 31 (FIG. 9). A guide hole 35 is formed in each guide piece 34. On the other hand, L-shaped turn-preventive pieces 22*a* are provided at opposed positions on the outer periphery of the slide member 22. By inserting the turn-preventive pieces 22*a* into the guide holes 35, the slide member 22 is prevented from turning relative to the turn-preventive member 31, but movable in the axial direction. The turn-preventive member 31 is formed by pressing a thin metal plate.

In this embodiment, by caulking the protrusions 32, the turn-preventive member 31 is coupled to the nut member 8 to prevent the turn-preventive member 31 from turning. But instead of providing the protrusions 32, the turn-preventive member 31 may be pressed against the bottom surface of the nut member 8 by pressing the elastic ring 21 to prevent the turn-preventive member 31 from turning.

In the lash adjuster A having such a structure, like the lash adjuster shown in FIG. 14, when a valve clearance is produced between the valve stem 12 and the adjust screw 4, by the bias of the elastic member 5, the adjust screw 4 will move in the axial direction while turning along the clearance flanks 7, thereby absorbing the valve clearance.

Also, when the adjust screw 4 receives push-in force by the valve stem 12, the adjust screw retracts until axial thread spaces formed between the female threads 3*a* and the male threads 4*a* disappear. When further push-in force is imparted, the push-in force is borne by the pressure flanks 6, which prevent the adjust screw 4 from retracting while turning.

Further, if the push-in loads applied from the valve stem 12 to the adjust screw 4 are continuously acting varying loads, the adjust screw 4 will retract in the axial direction while turning until the minimum value of the varying load becomes zero, thereby keeping the valve clearance constant.

By mounting the slide member 22 between the adjust screw 4 and the valve stem 12 and preventing the slide member 22 from turning relative to the nut member 8 while allowing it to slide in the axial direction, even if the valve stem 12 turns relative to the lifter body 1, its turning moment will not be transmitted to the adjust screw 4, so that only axial push-in force is transmitted. The axial push-in force is borne by the pressure flanks 6 at the thread engagement portions between the threaded hole 3 and the adjust screw 4, so that the adjust screw 4 is prevented from retracting while turning. As a result, it is possible to maintain a stable valve lifting amount.

Since the slide member 22 is kept inseparable from the litter body 1 by the turn-preventive member 31 and the elastic ring 21, which prevents the turn-preventive member 31 from coming off, in the state before the lash adjuster A is mounted in the valve gear, the slide member 22 will never fall off the lifter body 1. Thus it is possible to extremely easily mount the lash adjuster A in the valve gear.

Figure 10:
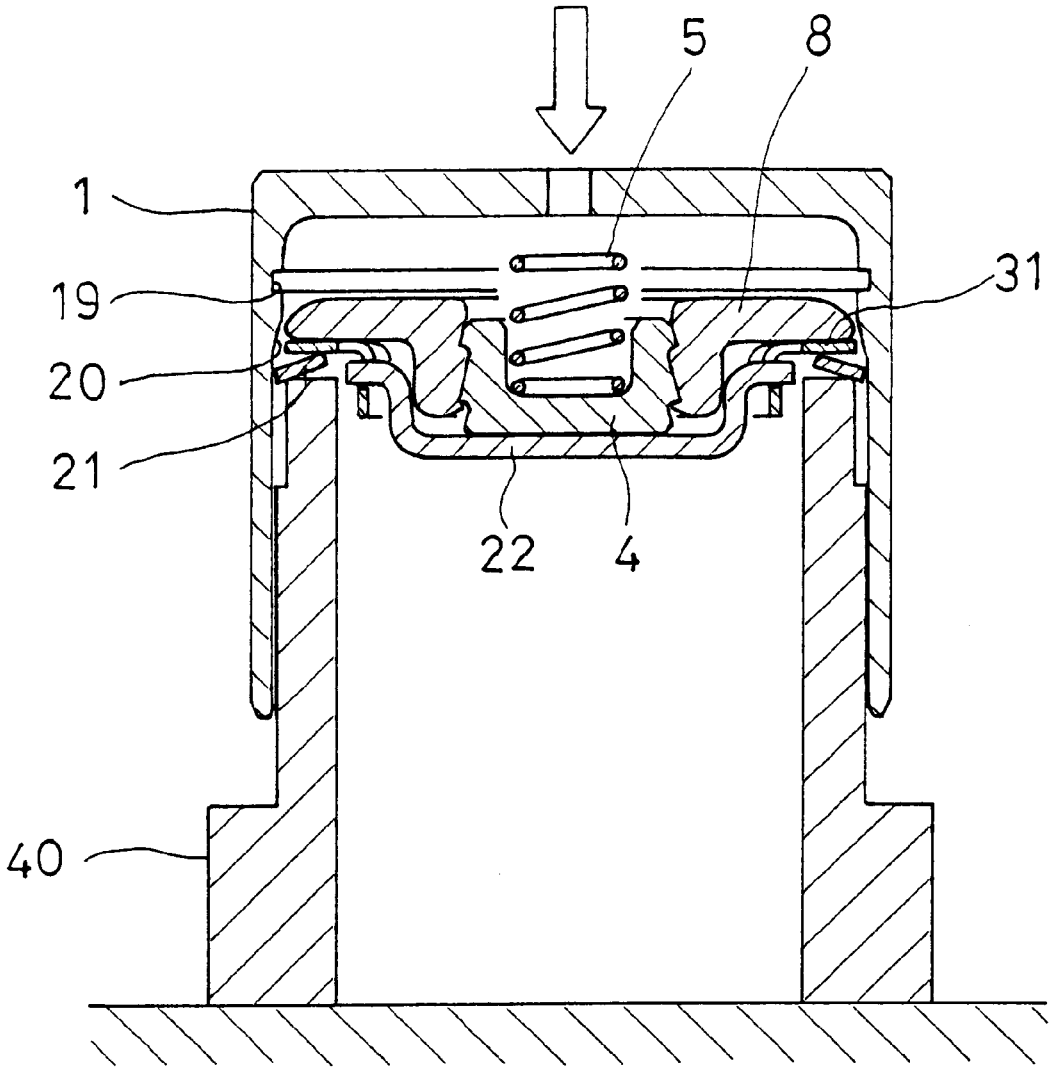
FIG. 10 is a vertical sectional front view showing an intermediate state of assembling of the lash adjuster.

FIG. 10 shows an example of assembling of the lash adjuster A. In this example, an assembly in which the elastic ring 21, nut member 8, adjust screw 4, elastic member 5, turn-preventive member 31 and slide member 22 have been assembled is placed on a cylindrical jig 40. The lifter body 1 is then fitted on and pushed from above. While the lifter body 1 is being pushed, the elastic ring 21 will be shrunk due to contact with the tapered surface 20. When the lifter body 1 is pushed to a position where the groove 19 is aligned with the elastic ring 21, the elastic ring will expand due to its resilience and engage in the groove 19. Thus the lash adjuster can be assembled extremely easily.

Figure 11:
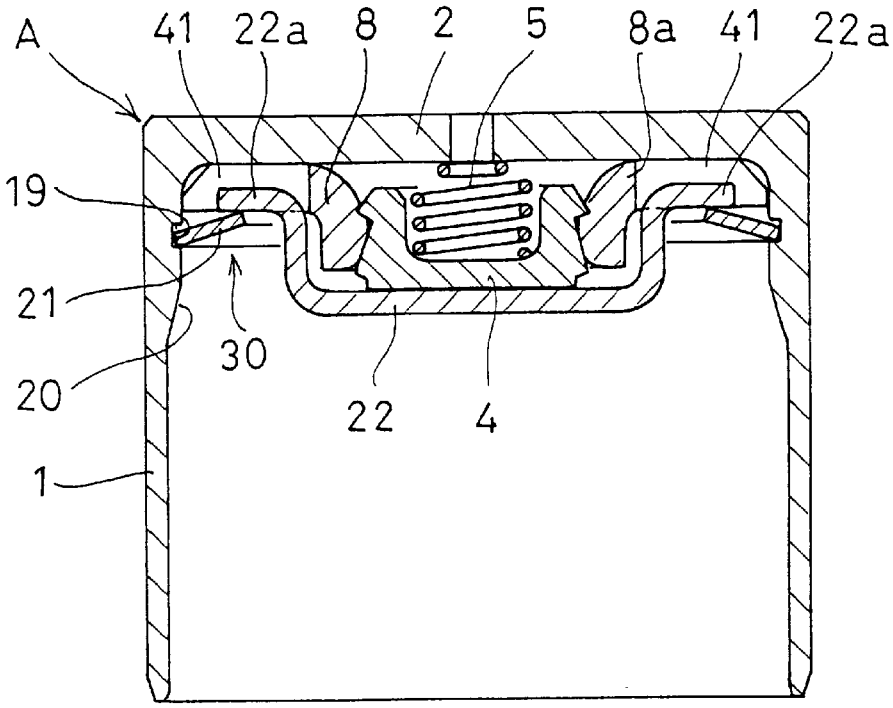
FIG. 11 is a vertical sectional front view of another embodiment.
Figure 12:
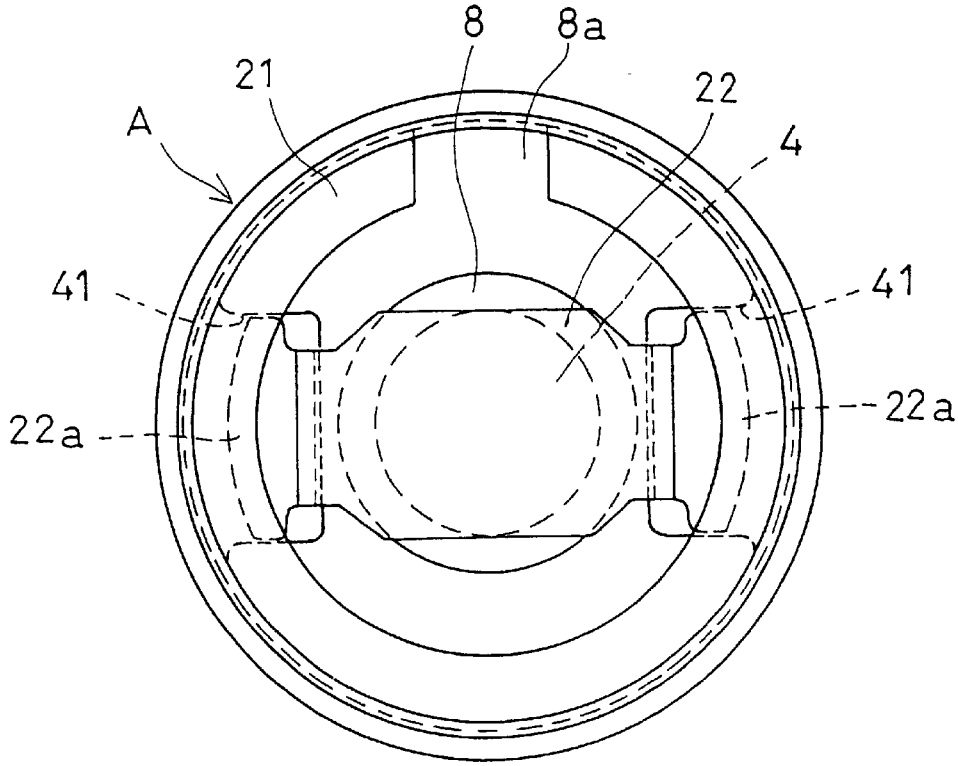
FIG. 12 is a bottom view of the same.

FIGS. 11 to 13 show another embodiment of this invention. This embodiment differs from the embodiment shown in FIGS. 7 and 8 only in the retaining mechanism 30. Therefore the same numerals are used for the same members and the description is omitted.

The retaining mechanism 30 shown in FIGS. 11 to 13 comprises cutouts 41 formed in the flange 8*a* of the nut member 8, the slide member 22 having L-shaped turn-preventive pieces 22*a* provided at both ends thereof and slidably fitted in the cutouts 41 of the nut member 8 to prevent the slide member 22 from turning relative to the nut member 8 and support it so as to be axially movable, and the elastic ring 21 for pressing the slide member 22 against the nut member 8 to prevent the turn-preventive pieces 22*a* from coming out of the cutouts 41.

By such a structure, the turn-preventive member 31 shown in FIGS. 7 and 8 is not needed any more.

This makes it possible to reduce the number of parts of the lash adjuster A and thus the cost and weight.

Figure 13A:
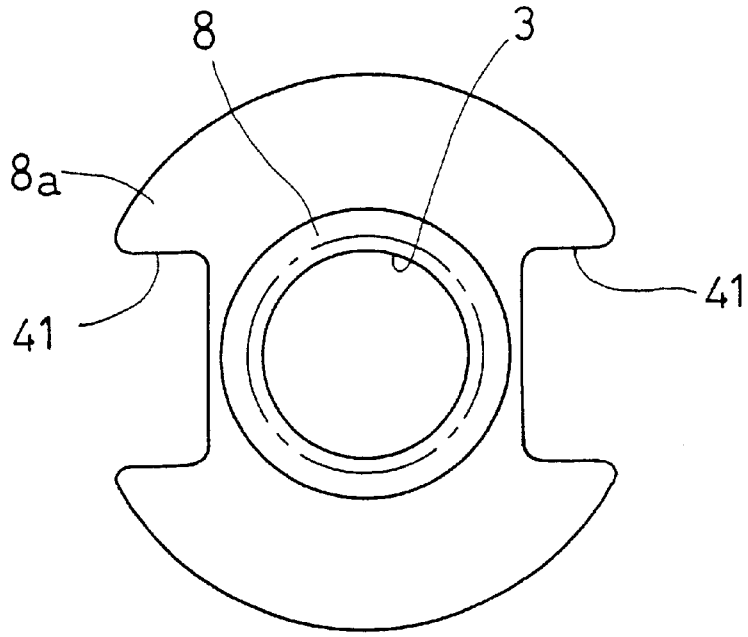
FIG. 13A is a bottom view of the nut member of the embodiment of FIG. 11.
Figure 13B:
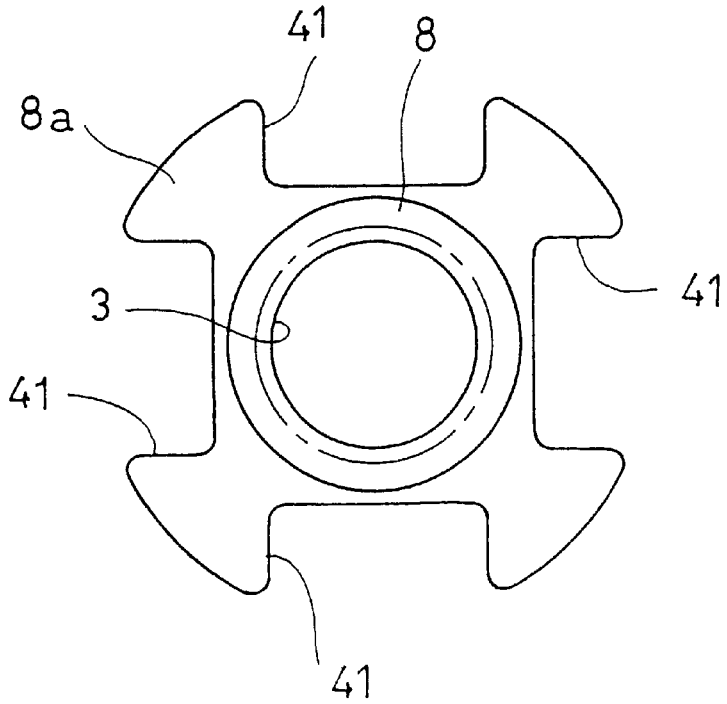
FIG. 13B is a bottom view of another example of the nut member.

The cutouts 41 formed in the flange 8*a* of the nut member 8 may be formed at intervals of 180° as shown in FIG. 13A or at intervals of 90° as shown in FIG. 13B.

If the cutouts 41 are formed at 90° intervals as shown in FIG. 13B, the turn-preventive pieces 22*a* do not have to be fitted in both of the cutouts 41 provided at opposed positions. This facilitates the mounting of the slide member 22 and permits reduction in weight of the nut member 8.

As described above, according to this invention, the surface roughness Ra of the pressure flanks, which receive axial push-in force applied to the adjusting screw, is set to 0.4 or over. Thus sufficient frictional force is obtainable between the pressure flanks of the female threads and male threads. Thus, even when axial loads in the push-in direction are applied from the valve stem to the adjusting screw, it is possible to prevent the adjusting screw from retracting while turning. Thus, the valve lifting amount can be kept substantially constant, so that it is possible to obtain stable valve lifting properties.

As described above, in the lash adjuster according to this invention, since the slide member which is prevented from turning relative to the lifter body and is slidable in the axial direction, is mounted between the adjust screw and the valve stem, even if the valve stem turns relative to the lifter body, it is possible to prevent torsional moment from being transmitted to the adjust screw, and thus it is possible to maintain a stable valve lifting amount.

Also, since the slide member is prevented from turning relative to the nut member and supported so as to be movable in the axial direction, before the lash adjuster is mounted on the valve gear, it is possible to prevent the slide member from falling off the lifter body. Thus the lash adjuster can be extremely easily mounted in the valve gear.

Further, by forming the tapered surface on the inner periphery of the lifter body, it is possible to assemble the lash adjuster by placing the elastic ring on a jig, placing on the jig an assembly in which the nut member, adjust screw, elastic member, turn-preventive member and slide member have been assembled, on the elastic ring, and pushing on the lifter body from above. Thus the lash adjuster can be assembled extremely easily.

TABLE 1

| Sample No. | Surface roughness Ra before shot peening | Surface roughness Ra after shot peening |
|---|---|---|
| 1 | 0.09 | 0.52 |
| 2 | 0.07 | 0.50 |
| 3 | 0.08 | 0.57 |
| 4 | 0.07 | 0.62 |
| 5 | 0.08 | 0.53 |
| 6 | 0.08 | 0.63 |
| 7 | 0.09 | 0.58 |
| 8 | 0.09 | 0.56 |
| 9 | 0.09 | 0.53 |
| 10 | 0.09 | 0.67 |
| 11 | 0.07 | 0.54 |
| 12 | 0.10 | 0.53 |
| 13 | 0.10 | 0.46 |
| 14 | 0.08 | 0.59 |
| 15 | 0.08 | 0.68 |
| 16 | 0.07 | 0.58 |
| 17 | 0.08 | 0.53 |
| 18 | 0.08 | 0.59 |
| 19 | 0.09 | 0.49 |
| 20 | 0.06 | 0.52 |
| Average | 0.08 | 0.56 |

TABLE 2

| Surface roughness (Ra) of threads of adjust screw | 0.1 | 0.2 | 0.4 | 0.8 | 6.3 | 12.5 | 25 |
|---|---|---|---|---|---|---|---|
| Stability in valve lifting amount in revolution sweep test | X | Δ | ○ | ○ | ○ | ○ | ○ |
| Hitch observed at clearance flank of adjust screw? | No | No | No | No | No | No | Yes |

What is claimed is:

1. A lash adjuster for use in a valve gear, comprising a lifter body having an end plate, mounted between a cam and a valve stem and supported so as to be slidable in the axial direction, an adjust screw in threaded engagement with a threaded hole formed in the bottom surface of the end plate of said lifter body, and an elastic member biasing said adjust screw toward the top end of said valve stem, wherein threads of female threads of said threaded hole and male threads formed on the outer periphery of said adjust screw are serrated so that the flank angle of pressure flanks of the male threads and the female threads, which receive axial push-in force applied to said adjust screw, is larger than the flank angle of clearance flanks of the male threads and the female threads, wherein the surface roughness Ra of the pressure flanks of at least one of said female threads and said male threads is set to 0.4 or over.

2. A lash adjuster as claimed in claim 1 wherein the surface roughness Ra of said clearance flanks is less than 25.

3. A lash adjuster for use in a valve gear, comprising a lifter body having an end plate and mounted between a cam and a valve stem so as to be slidable in the axial direction, a nut member fixedly mounted on the bottom surface of said end plate of said lifter body, an adjust screw in threaded engagement with a threaded hole formed in said nut member, and an elastic member mounted in said threaded hole to bias said adjust screw in the axial direction, wherein threads of female threads of said threaded hole and male threads formed on the outer periphery of said adjust screw are serrated so that the flank angle of pressure flanks of the male threads and the female threads, which receive axial push-in force applied to said adjust screw, is larger than the flank angle of clearance flanks of the male threads and the female threads, wherein a slide member is mounted between said adjust screw and said valve stem and a retaining means is provided to prevent said slide member from turning relative to said nut member while supporting said slide member so as to be movable in the axial direction.

4. A lash adjuster as claimed in claim 3 wherein said retaining means comprise an elastic ring having its outer peripheral portion fitted in a groove formed in the inner periphery of said lifter body, and a ring-shaped turn-preventive member pressed against the bottom surface of said nut member by said elastic ring, a plurality of guide pieces formed to extend downwardly from the inner periphery of said turn-preventive member, said guide pieces each being formed with a guide hole, said slide member having a plurality of turn-preventive pieces formed thereon, said turn-preventive pieces being inserted in said guide holes to prevent said slide member from turning and support said slide member so as to be movable in the axial direction.

5. A lash adjuster as claimed in claim 4 wherein a plurality of protrusions are formed on the outer periphery of said turn-preventive member and said turn-preventive member is coupled to said nut member by caulking said protrusions.

6. A lash adjuster as claimed in claim 4 wherein said nut member is mounted so as to contact the bottom surface of said end plate of said lifter body and said nut member is prevented from turning by pressing it against the bottom surface of said end plate with said elastic ring.

7. A lash adjuster as claimed in claim 3 wherein said retaining means comprises an elastic ring mounted in a groove formed in the inner periphery of said lifter body for pressing said nut member against the bottom surface of the end plate of said lifter body, said nut member being formed with cutouts in an outer periphery thereof at opposed positions, said slide member having L-shaped turn-preventive pieces adapted to be fitted into said cutouts formed in said nut member and prevented by said elastic ring from coming out of said cutouts.

8. A lash adjuster as claimed in claim 4 wherein said elastic ring comprises a disc spring having a cut-out portion in its circumference.

9. A lash adjuster as claimed in claim 4 wherein a tapered surface is formed on the inner periphery of said lifter body below said groove.

10. A lash adjuster as claimed in claim 5 wherein said nut member is mounted so as to contact the bottom surface of said end plate of said lifter body and said nut member is prevented from turning by pressing it against the bottom surface of said end plate with said elastic ring.

11. A lash adjuster as claimed in claim 5 wherein said elastic ring comprises a disc spring having a cut-out portion in its circumference.

12. A lash adjuster as claimed in claim 6 wherein said elastic ring comprises a disc spring having a cut-out portion in its circumference.

13. A lash adjuster as claimed in claim 7 wherein said elastic ring comprises a disc spring having a cut-out portion in its circumference.

14. A lash adjuster as claimed in claim 5 wherein a tapered surface is formed on the inner periphery of said lifter body below said groove.

15. A lash adjuster as claimed in claim 6 wherein a tapered surface is formed on the inner periphery of said lifter body below said groove.

16. A lash adjuster as claimed in claim 7 wherein a tapered surface is formed on the inner periphery of said lifter body below said groove.

17. A lash adjuster as claimed in claim 8 wherein a tapered surface is formed on the inner periphery of said lifter body below said groove.

* * * * *